US007104828B1

(12) United States Patent
Lin

(10) Patent No.: US 7,104,828 B1
(45) Date of Patent: Sep. 12, 2006

(54) BULB SOCKET

(76) Inventor: Chia-Kuan Lin, 4F, No. 50, Sanmin Rd., Lujhou City, Taipei Hsien (TW)

( * ) Notice: Subject to any disclaimer, the term of this patent is extended or adjusted under 35 U.S.C. 154(b) by 0 days.

(21) Appl. No.: 11/392,352

(22) Filed: Mar. 29, 2006

(51) Int. Cl.
*H01R 4/50* (2006.01)
*H01R 13/625* (2006.01)

(52) U.S. Cl. ..... 439/337; 439/220; 362/430

(58) Field of Classification Search ..... 439/220, 439/232, 280, 336, 337, 375, 414, 419, 699.2; 362/430, 649, 655–659
See application file for complete search history.

(56) References Cited

U.S. PATENT DOCUMENTS 2,127,473 A * 8/1938 Sacco ..... 439/616
3,363,217 A * 1/1968 Garver et al. ..... 439/337
4,256,989 A * 3/1981 Trutner et al. ..... 313/318.01
6,779,911 B1 * 8/2004 Chang ..... 362/430
2006/0044842 A1 * 3/2006 Pazula ..... 362/655

* cited by examiner

*Primary Examiner*—Hae Moon Hyeon
(74) *Attorney, Agent, or Firm*—Jackson Walker, LLP

(57) ABSTRACT

A bulb socket is used with a bulb having a base and two mounting legs each including an enlarged member and has a casing, a bracket and a compression tab. The casing is hollow and has an open bottom. The bracket is mounted in the open bottom of the casing and has two openings, two curved slots and two ridges. The openings and curved slots are defined through the bracket. Each curved slot has an inlet hole and a locking recess. The ridges protrude from the bracket respectively along and adjacent to the curved slots. The compression tab is mounted on the bracket and has two feet extending respectively through openings. The feet pressing against the base and the ridges adjacent to the enlarged members prevent the vertical and horizontal movements of the enlarged members when no external force is applied to the bulb.

5 Claims, 7 Drawing Sheets

BULB SOCKET

BACKGROUND OF THE INVENTION

1. Field of the Invention

The present invention relates to a bulb socket, and more particularly to a bulb socket that has two ridges and a compression tab to securely hold a bulb in the bulb socket.

2. Description of Related Art

A conventional energy saving bulb is used with a bulb socket. The energy saving bulb has a base and two mounting legs. The mounting legs extend out from the base and each mounting leg has a distal end and an enlarged member formed on the distal end. The bulb socket is hollow, is mounted on ceiling or wall and has an inner surface and two curved slots defined through the bulb socket. Each slot has two ends, an inlet hole and a locking recess. The inlet and locking recesses are defined respectively in the ends. The inlet hole is larger than the enlarged member. Extending the mounting legs respectively through the inlet holes in the curved slots and rotating the energy saving bulb relative to the bulb socket cause the enlarged members to be locked in the locking recesses so that the energy saving bulb is installed in the bulb socket.

However, inadvertent external force such as quake may rotate the energy saving bulb in the bulb socket and cause the mounting legs to fall out of the curved slots through the inlet holes and therefore result in the detachment of the energy saving bulb from the bulb socket.

To solve the problem of the unexpected detachment of the energy saving bulb from the bulb socket, a lock assembly to lock the energy saving bulb on the bulb socket was developed. The lock assembly has a recess formed in the bulb socket and a locking slide slidably mounted on the base of the energy saving bulb and engaging the recess when the energy saving bulb is installed in the bulb socket. However, the structure of the lock assembly is complicated and increases the cost of the energy saving bulb with the locking slide which customers adopting the bulb socket must use exclusively.

To overcome the shortcomings, the present invention provides a bulb socket to mitigate or obviate the aforementioned problems.

SUMMARY OF THE INVENTION

The main objective of the invention is to provide a bulb socket that has two ridge and a compression tab to securely hold a bulb in the bulb socket.

A bulb socket in accordance with the present invention has a casing, a bracket and a compression tab. The casing is hollow and has an open bottom. The bracket is mounted in the open bottom of the casing and has two openings, two curved slots and two ridges. The openings and curved slots are defined through the bracket. Each curved slot has an inlet hole and a locking recess. The ridges protrude from the bracket respectively along and adjacent to the curved slots. The compression tab is mounted on the bracket and has two feet extending respectively through openings.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
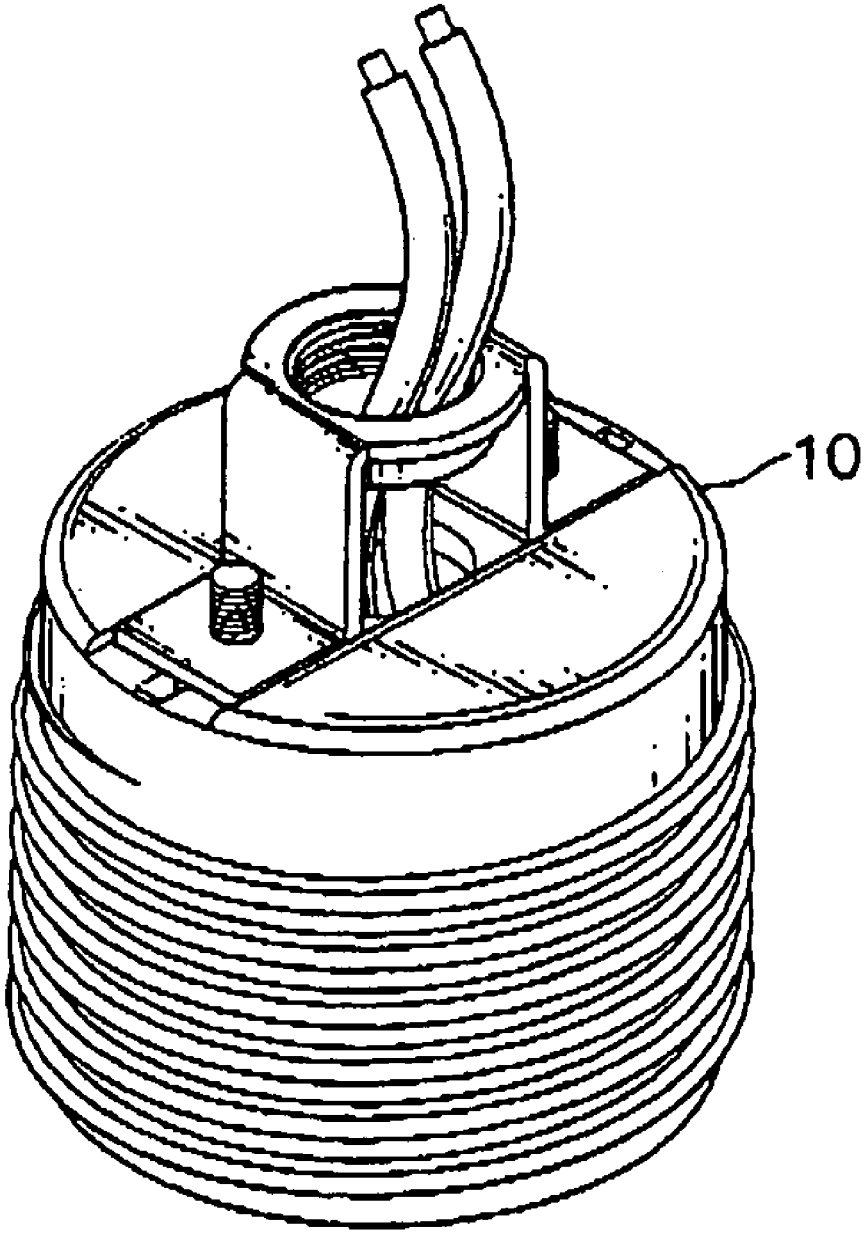
FIG. 1 is a perspective view of a bulb socket in accordance with present invention.
Figure 2:
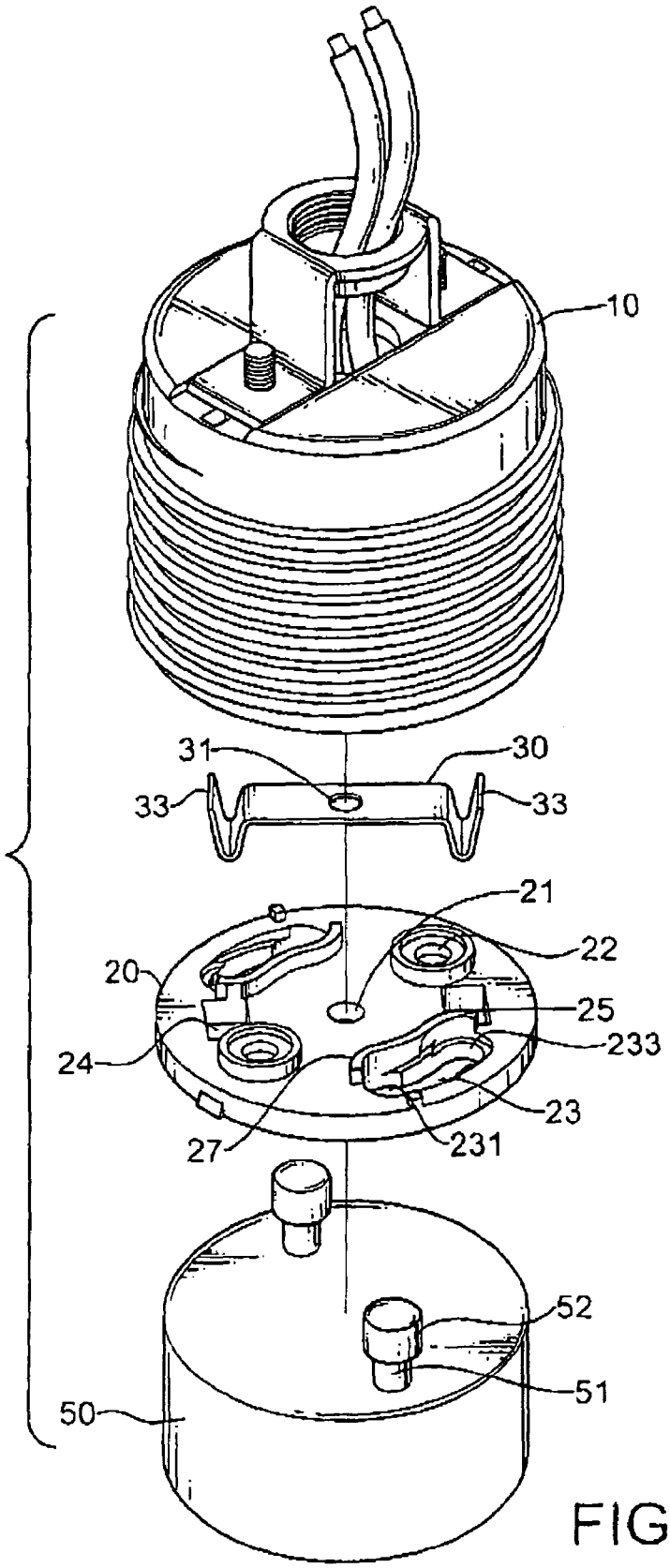
FIG. 2 is an exploded perspective view of the base of the bulb and the bulb socket in FIG. 1.

With reference to FIGS. 1 and 2, a bulb socket in accordance with the present invention is used with a bulb, especially an energy saving bulb. The bulb has a body and a base (50). The base (50) has two mounting legs (51). The mounting legs (51) extend out from the base (50) and each mounting leg (51) has a distal end and an enlarged member (52). The enlarged member (52) is formed on the distal end and has a size.

The bulb socket comprises a casing (10), a bracket (20) and a compression tab (30).

Figure 2A:
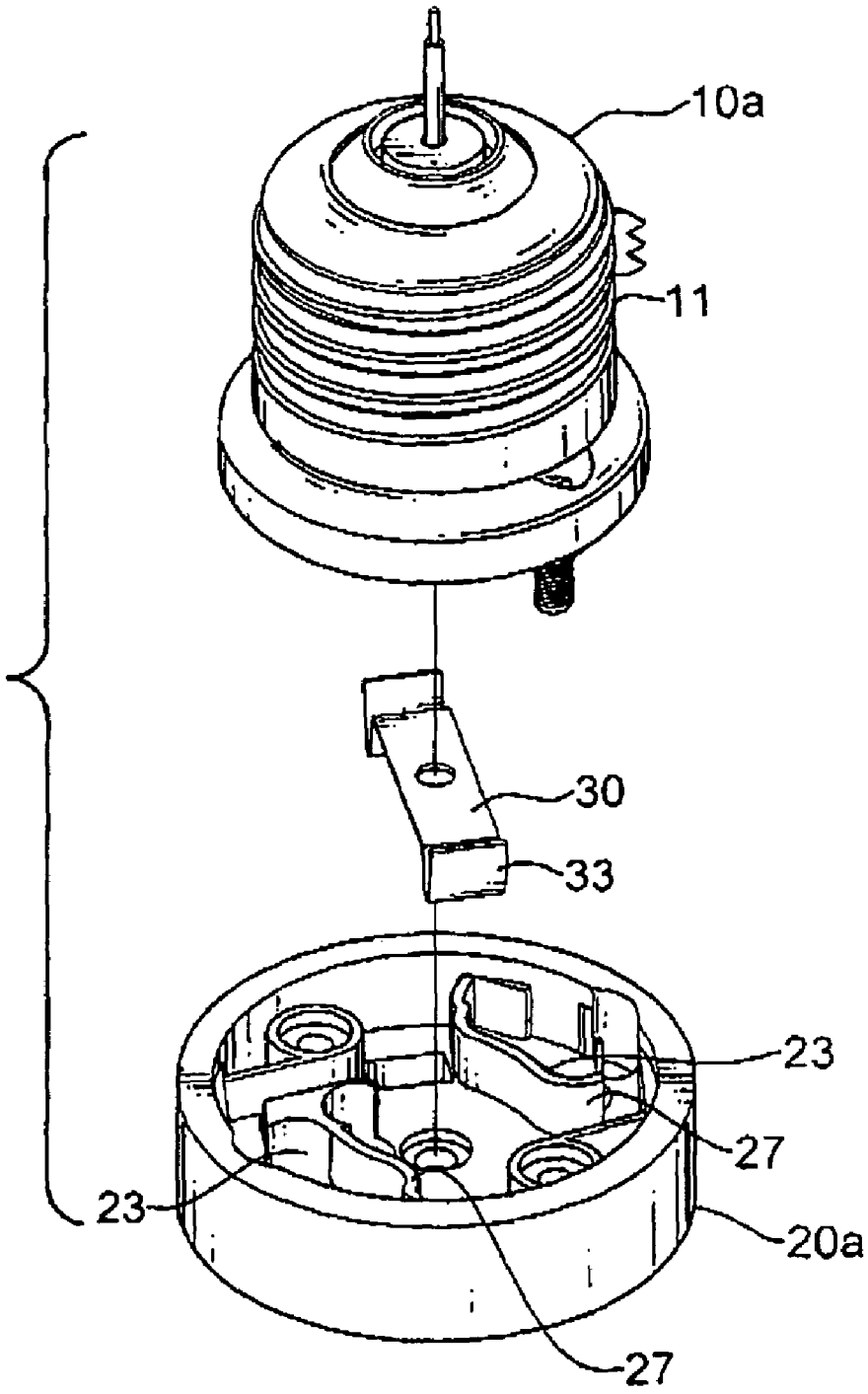
FIG. 2A is an exploded perspective view of an another embodiment of a bulb socket in accordance with the present invention.

With further reference to FIG. 2A, the casing (10, 10*a*) is hollow, may either be mounted securely on a wall or ceiling or have an outer thread (11) corresponding to an inner thread in a conventional incandescent bulb socket so that the bulb socket becomes a bulb adapter to mount the energy saving bulb in the incandescent bulb socket. The casing (10, 10*a*) has a top, an open bottom.

Figure 5:
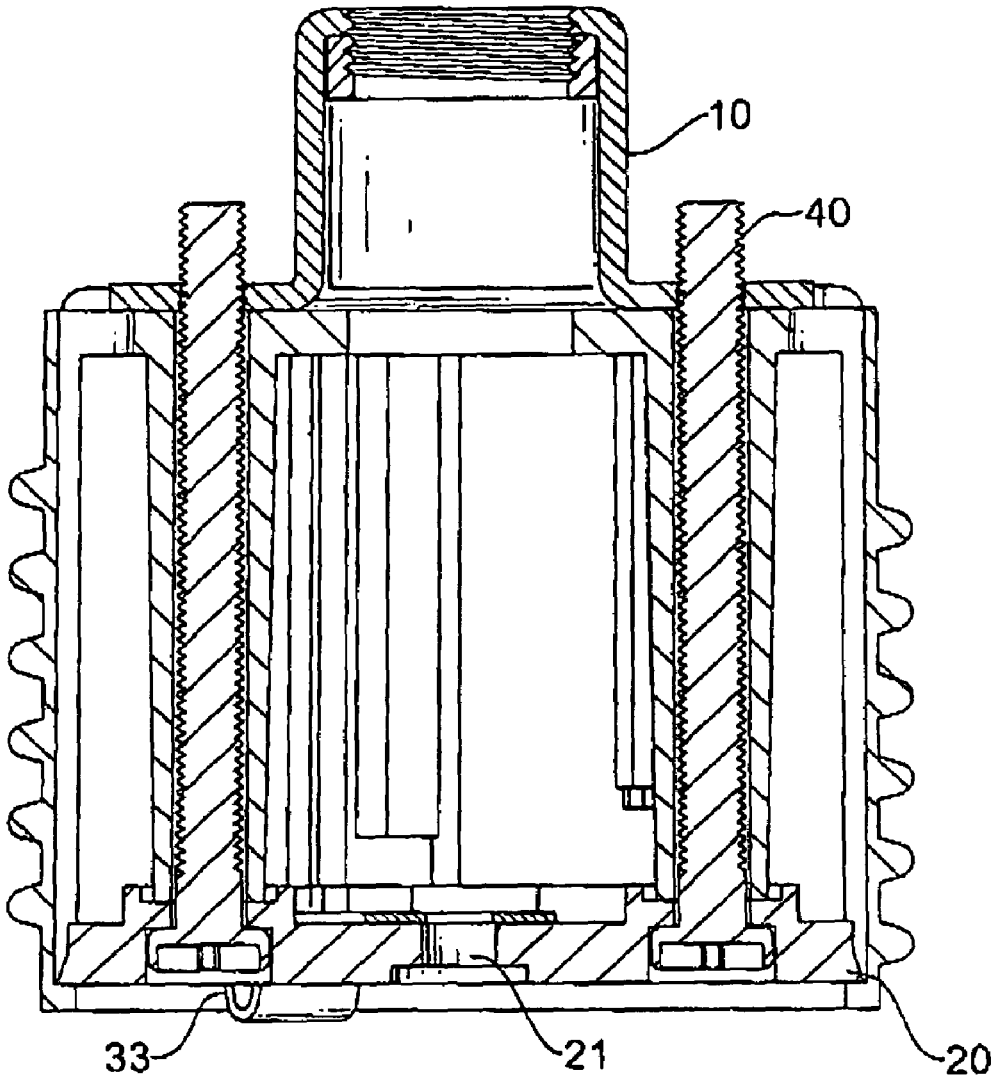
FIG. 5 is a cross sectional view of the bulb socket in FIG. 1.

With reference to FIGS. 2 and 5, the bracket (20,20*a*) is mounted in the open bottom of the casing (10) and has an inside surface, an outside surface, a central hole (21), multiple mounting holes (22), two openings (24), two curved slots (23), two ridges (25) and two sidewalls (27).

The central hole (21) is defined through the bracket (20,20*a*).

The mounting holes (22) are defined through the bracket (20,20*a*), through which multiple fasteners that may be screws (40) extend respectively.

The openings (24) are defined through the bracket (20, 20*a*).

Figure 3:
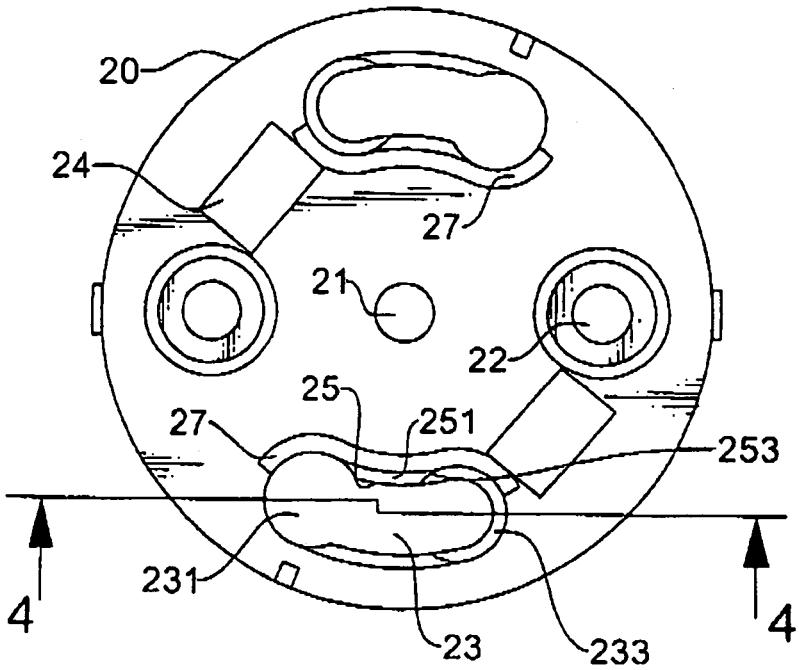
FIG. 3 is a top view of the bracket of the bulb socket in FIG. 2.
Figure 4:
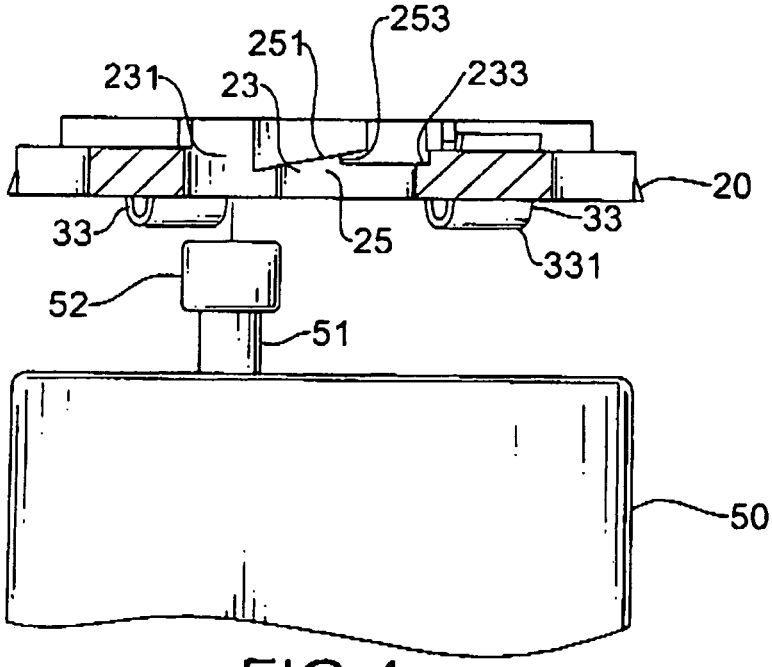
FIG. 4 is an exploded side view in partial section of base of the bulb and the bracket of the bulb socket along line A—A in FIG. 3.

With reference to the FIGS. 3 and 4, the curved slots (23) correspond to the mounting legs (51) on the base (50) of the bulb, are defined concentrically through the bracket (20,20*a*) and each curved slot (23) has two ends, an inlet hole (231) and a locking recess (233). The inlet hole (231) is defined in one end of the curved slot (23) and has a size larger than that of each enlarged member (52) on the base (50) of the bulb to allow the enlarged member (52) to extend through the inlet hole (231). The locking recess (233) is defined in the other end of the curved slot (23) and allows the enlarged member (52) to be locked in the locking recess (233).

The ridges (25) correspond to the curved slots (23), protrude from the inside surface of the bracket (20,20*a*) respectively along and adjacent to the curved slots (23). Each ridge (25) thickens from the inlet hole (231) to the locking recess (233) of a corresponding one of the curved slots (23) and has an inclined guiding surface (251) and a blocking surface (253). The inclined guiding surface (251) guides the enlarged member (52) on a corresponding mounting leg (51) to smoothly move from the inlet hole (231) to the locking recess (233) when the bulb with the mounting legs (51) extends through inlet holes (231) is rotated. The blocking surface (253) may be perpendicular to the inside surface of the bracket (20,20*a*), is adjacent to a corresponding one of the locking recesses (233), blocks and prevents the enlarged member (52) from shifting horizontally out of the locking recess (233).

The sidewalls (27) extend from the inside surface of the bracket (20,20*a*) respectively along the curved slots (23) to prevent the mounting legs (51) from contacting conductive elements inside the casing to cause a short circuit of the bulb.

Figure 6:
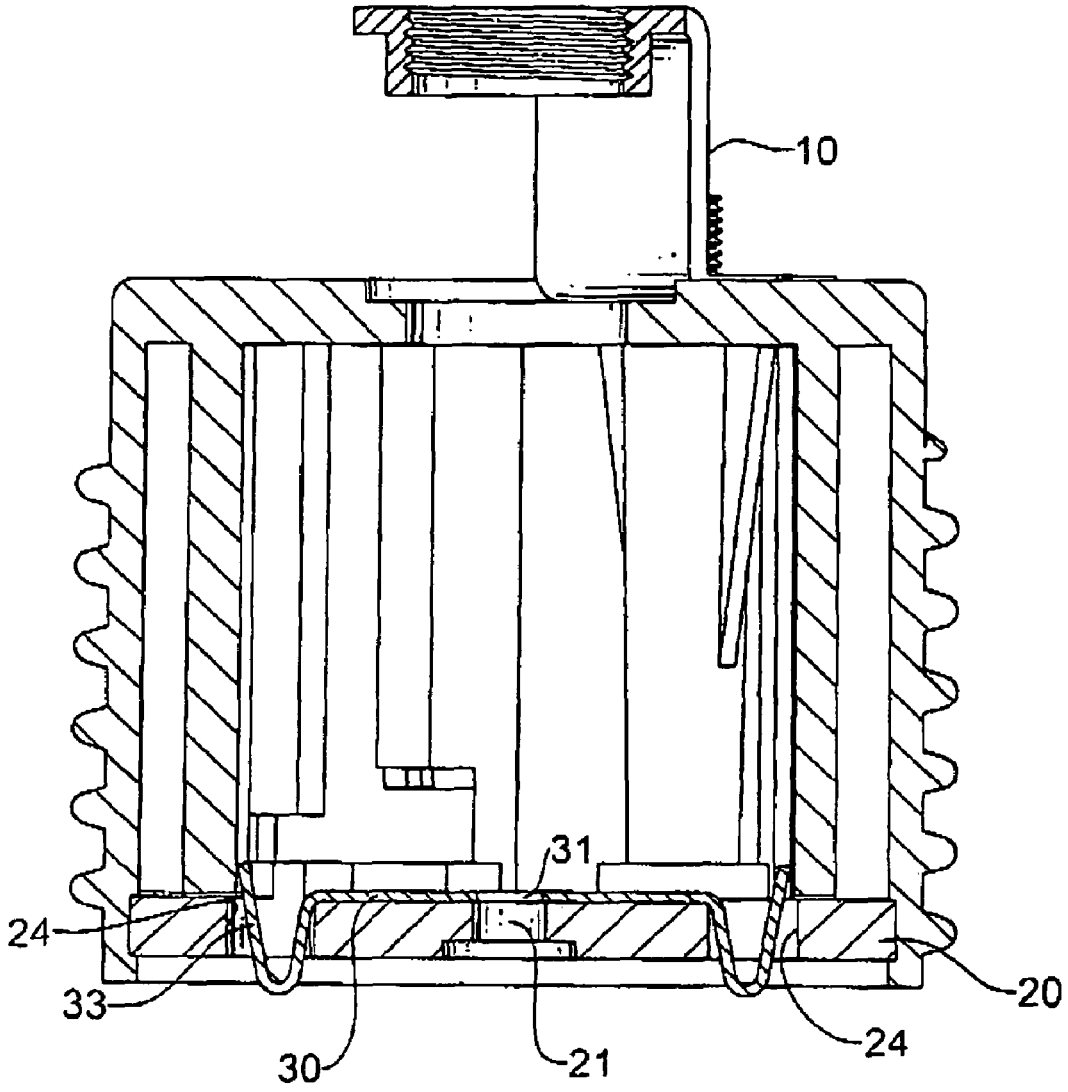
FIG. 6 is another cross sectional view of the bulb socket in FIG. 1.

With reference to FIGS. 2, 2A and 6, the compression tab (30) is flexible, is mounted on the inside surface of the bracket (20,20*a*) and has two ends, a central hole (31) and two feet (33). The central hole (31) is defined through the compression tab (30). Extending a fastener through the central holes (21, 31) in the bracket and the compression tab (30) securely mount the compression tab (30) on the bracket (20). The feet (33) are V-shaped, are formed respectively on the ends by bending the compression tab (30), extend respectively through openings (24) in the bracket (20) out of the outside surface and press against the base (50) of the bulb. The feet (33) pressing against the base (50) prevent the enlarged members (52) on the mounting legs (51) from arising over the ridges (25) to further shift to and fall out of the inlet holes (231) when an inadvertent external impact effects the bulb or bulb socket.

Figure 7:
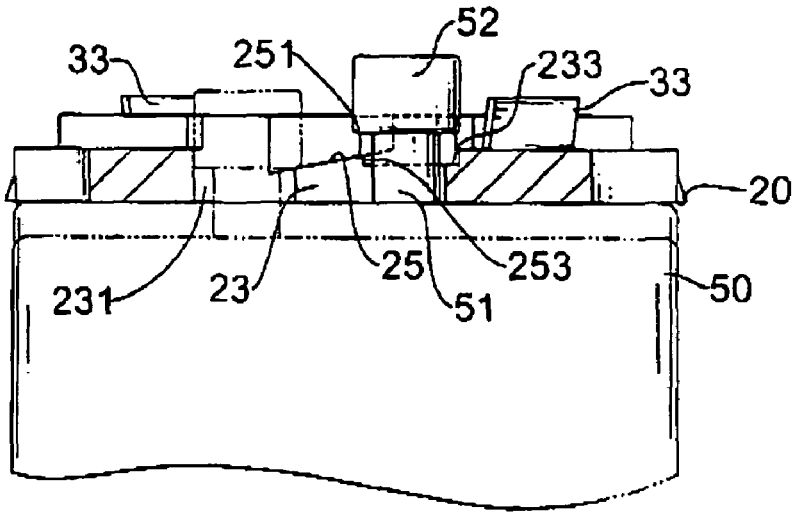
FIG. 7 is an operational side view in partial section of the enlarged member of the base of the bulb moving along the inclined guiding surface of one ridge one the bracket of the bulb socket in FIG. 4.
Figure 8:
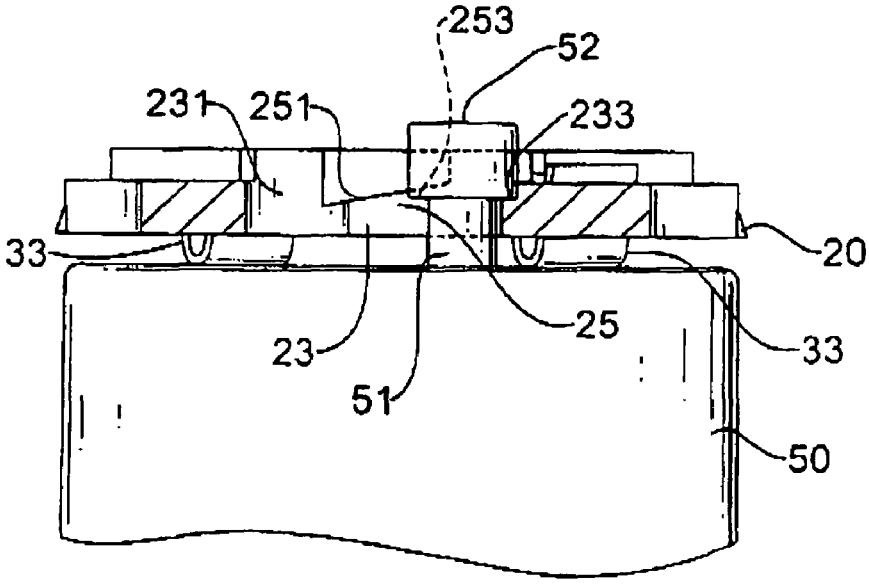
FIG. 8 is an operational side view in partial sectional of the enlarged member locked in the locking recess in one curved slot in FIG. 7.

With reference to FIGS. 7 and 8, extending the enlarged members (52) on the base (50) of the bulb through the inlet holes (231) and rotating the bulb smoothly move the enlarged members (52) respectively along the inclined guiding surfaces (251) of the ridges (25) from the inlet holes (231) to the locking recesses (233). The enlarged members (52) instantly move down and are locked respectively in the locking recesses (232) with the resilient force of the feet (33) on the compression tab (30) pressing against the base (50) once shifting over the ridges (25).

The feet (33) pressing against the base (20) and the blocking surfaces (253) on the ridges (25) respectively adjacent to the enlarged members (52) prevent the vertical and horizontal movements of the enlarged members (52) when no external force is applied to the bulb. Therefore, the bulb socket with the ridges (25) and the compression tab (30) securely holds the bulb.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A bulb socket comprising:

a casing being hollow and has an open bottom;

a bracket mounted in the open bottom of the casing and having an inside surface;

an outside surface;

two openings defined through the bracket;

two curved slots defined concentrically through the bracket and each curved slot having two ends, an inlet hole defined in one end of the curved slot and a locking recess defined in the other end of the curved slot;

two ridges corresponding to the curved slots, protruding from the inside surface of the bracket respectively along and adjacent to the curved slots, each ridge having a blocking surface being adjacent to a corresponding one of the recesses; and a compression tab being flexible, mounted on the inside surface of the bracket and having two ends and two feet formed respectively on the ends of the compression tab and extending respectively through openings in the bracket out of the outside surface.

2. The bulb socket as claimed in claim 1, wherein each ridge thickens from the inlet hole to the locking recess of a corresponding one of the curved slots and further has an inclined guiding surface.

3. The bulb socket as claimed in claim 2, wherein the feet are V-shaped.

4. The bulb socket as claimed in claim 3, wherein the bracket further has two sidewalls extending from the inside surface of the bracket respectively along the curved slots.

5. The bulb socket as claimed in claim 4, wherein the bulb socket is a bulb adapter adapted to mount an energy saving bulb on an incandescent bulb socket and the casing further has an outer thread.

* * * * *